United States Patent [19]

O'Neal et al.

[11] 4,176,980

[45] Dec. 4, 1979

[54] DISPOSABLE TOOTHBRUSH AND DENTIFRICE COMBINATION

[76] Inventors: Chester L. O'Neal, 101 S. Locust, Greencastle, Ind. 46135; Danny C. O'Neal, 1652 Lorraine Dr., Corona, Calif. 91720

[21] Appl. No.: 857,008

[22] Filed: Dec. 2, 1977

[51] Int. Cl.[2] ..... A46B 11/02

[52] U.S. Cl. ..... 401/162; 401/184; 401/276; 401/287

[58] Field of Search ..... 401/150, 153, 156, 162, 401/183, 184, 186, 276, 287

[56] References Cited

U.S. PATENT DOCUMENTS

| | | | |
|---|---|---|---|
| 1,142,566 | 6/1915 | Jackson | 401/184 |
| 2,795,000 | 6/1957 | Lomholdt | 401/162 |
| 3,653,778 | 4/1972 | Freiling | 401/183 |
| 3,738,762 | 6/1973 | Moore et al. | 401/186 |

FOREIGN PATENT DOCUMENTS

| | | | |
|---|---|---|---|
| 254459 | 11/1962 | Australia | 401/183 |
| 197961 | 5/1958 | Austria | 401/183 |
| 886082 | 11/1971 | Canada | 401/176 |
| 2341843 | 2/1975 | Fed. Rep. of Germany | 401/183 |
| 1207205 | 8/1959 | France | 401/184 |
| 1282995 | 12/1961 | France | 401/183 |
| 728343 | 4/1955 | United Kingdom | 401/291 |
| 889139 | 2/1962 | United Kingdom | 401/183 |
| 1266628 | 3/1972 | United Kingdom | 401/183 |

*Primary Examiner*—Clyde I. Coughenour

[57] ABSTRACT

A toothbrush and dentifrice combination, at least partially disposable, including an elongated handle having a central axis and an elongated cavity offset from the central axis therein, the offset cavity containing an amount of dentifrice material and defining a thin-walled portion and a thick-walled portion in the handle, and a head being attached to the handle and having an inner elongated cavity and a number of bristles defining a brushing surface thereon, the head further including three outlet openings in the brushing surface connected to the inner elongated cavity therein, which is in turn connected to the offset cavity in the handle. The handle is one integral piece of a resilient thermoplastic material and the thin-walled portion in the handle is readily compressible within its elastic limit a sufficient amount to collapse the offset cavity in the handle and force the dentifrice material into the inner cavity in the head and out through the outlet openings in the brushing surface. Also provided is an air intake aperture and hinged flap arrangement in the handle for preventing air from entering the offset cavity in the handle while the resilient thin-walled portion is being compressed and for then allowing air to enter the offset cavity after the compressing and while the resilient thin-walled portion returns to its original configuration.

3 Claims, 5 Drawing Figures

DISPOSABLE TOOTHBRUSH AND DENTIFRICE COMBINATION

BACKGROUND OF THE INVENTION

1. Field of the Invention

This invention relates to the field of toothbrushes and particularly to disposable toothbrush and dentifrice combinations.

2. Description of the Prior Art

The art is replete with many varied devices and methods for applying dentifrice material to an individual's teeth in order to prevent decay and promote general dental hygiene. In this regard, much research has been done in the area of at least partially disposable toothbrush and dentifrice combinations and a variety of U.S. patents have been granted for such devices. The following represents a list of several patents deemed relevant in this regard:

| Patent No. | Inventor | Issue Date |
|---|---|---|
| 2,550,190 | Greenberg | 4/24/51 |
| 3,292,644 | Ericson | 12/20/77 |
| 3,378,870 | Matsunaga | 4/23/68 |
| 3,491,396 | Eannarino et al. | 1/27/70 |
| 3,536,410 | Wargoe | 10/27/70 |
| 3,691,585 | Flom | 9/19/72 |
| 4,030,845 | Deckert | 6/21/77 |

Specifically, the Greenberg and Wargoe references disclose toothbrushes wherein the dentifrice material is located in a special compartment in the head adjacent to the bristles. The Ericson reference discloses a similar toothbrush in which the dentifrice material is located in a central cavity in the handle with the brush head being bendable and removable from the handle.

The other references, on the other hand, disclose various disposable structures in which the dentifrice material is initially applied in some manner to at least part of the bristles on the brush head.

The problems encountered with such prior art disposable toothbrush and dentifrice combinations are as many and varied as the individual structures themselves. In this regard, the major considerations underlying the design and development of such present and future devices is to provide a disposable toothbrush and dentifrice combination that is structurally sound, easily operable, practically efficient and effective in use, and economically feasible to both manufacture and market.

SUMMARY OF THE INVENTION

One embodiment of the present invention comprises a disposable toothbrush and dentifrice combination including an elongated handle having a central axis and an elongated cavity offset from the central axis therein, the offset cavity containing an amount of dentifrice material and defining a thin-walled portion and a thick-walled portion in the handle, a head having an inner elongated cavity and a plurality of bristles defining a brushing surface thereon, the head further including a plurality of outlet openings in the brushing surface connected to the inner elongated cavity therein, means for attaching the head to the handle and for connecting the inner cavity in the head with the offset cavity in the handle, and means for compressing the thin-walled portion in the handle and for forcing dentifrice material into the cavity in the head and out through the outlet openings in the brushing surface, the thick-walled portion in the handle being generally rigid and not compressible.

In one mode of practicing the above embodiment, the handle is one integral piece of a resilient thermoplastic material and the means for compressing and for forcing comprises means for resiliently compressing the thin-walled portion in the handle within its elastic limit a sufficient amount to collapse the offset cavity in the handle. Air intake means including an aperture and a hingedly attached inner flap are also located in the handle for preventing air from entering the offset cavity while the resilient thin-walled portion in the handle is compressed and for allowing air to enter the offset cavity after the compressing is completed. In this manner, the resilient thin-walled portion can return to its original configuration after the compressing because air enters the offset cavity and replaces the forced-out dentifrice material. The head is fixedly secured to the handle and the toothbrush can be simply discarded after the amount of dentifrice material is exhausted.

In a second mode of practicing the above embodiment, the head is screwably attached to one end of the handle such that it may be readily removed. In this manner, the handle can be removed and simply discarded after the amount of dentifrice material is exhausted. The head, on the other hand, can be connected to other replacement handles with fresh supplies of dentifrice material and, in this way, continually used until the brushing surface becomes so worn that the head itself requires replacement.

One object of the present invention is to provide a new and improved disposable toothbrush and dentifrice combination.

Another object of the present invention is to provide a disposable toothbrush that contains a several days' supply of dentifrice material in its handle while also being structurally sturdy enough to permit vigorous brushing and thereby promote general dental hygiene.

Related objects and advantages of the present invention will be apparent from the following description.

DESCRIPTION OF THE PREFERRED EMBODIMENT

Figure 1:
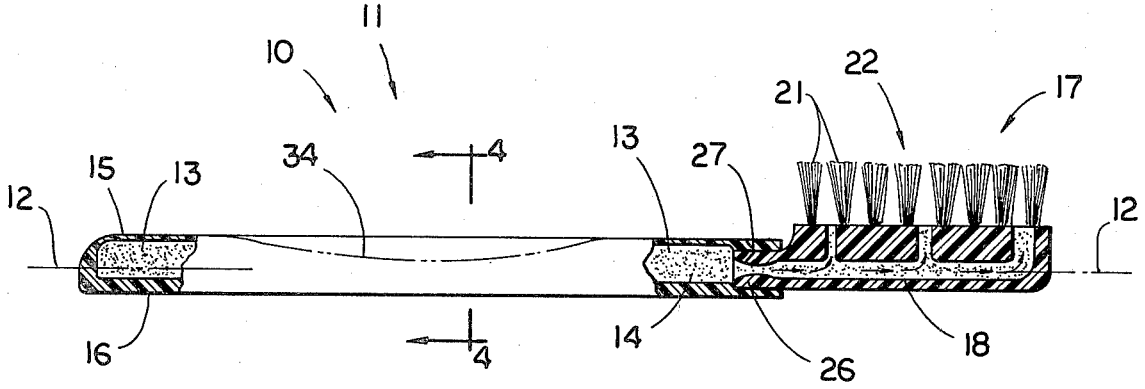
FIG. 1 is a part-sectional side view of the disposable toothbrush and dentifrice combination comprising one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIG. 1, the disposable toothbrush and dentifrice combination 10 comprising one embodiment of the present invention is therein depicted. Toothbrush 10 includes an elongated handle 11 having a central axis 12 and an elongated inner cavity 13 which is offset from the central axis therein. This offset cavity 13 contains an amount of dentifrice material 14 and generally defines a thin-walled portion 15 and a thick-walled portion 16 in the handle 11. Although many types of dentifrice material are commercially available and may be successfully combined in the present invention, it has been found that a paste-like or gelled material, being highly viscous, is best suited for use in the present invention because it tends not to leak or drain voluntarily out through the holes in the brushing surface of the head, as further discussed below.

Toothbrush 10 also includes a head 17 which has an inner elongated cavity 18 and a plurality of bristles 21 defining a brushing surface 22 on the head. Three outlet openings or holes 23 through 25 open at the base of the bristles 21 on brushing surface 22 and connect to the inner cavity 18. Head 17 is then attached to one end of handle 11 and inner cavity 18 in the head is connected to offset cavity 13 in the handle to allow dentifrice material to flow through the head 17 and on to the brushing surface 22.

Figure 2:
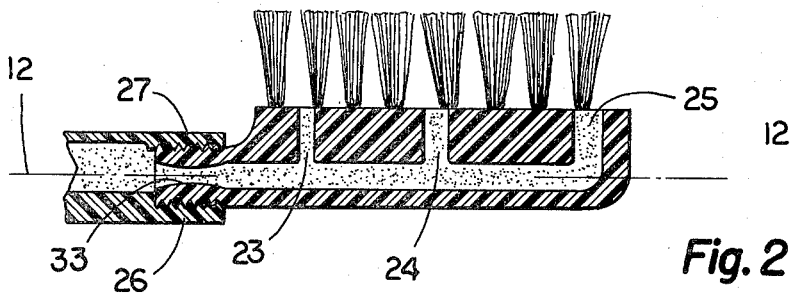
FIG. 2 is an enlarged sectional view of the head portion of the disposable toothbrush combination in FIG. 1.

Referring now to both FIGS. 1 and 2, head 17 may be attached to handle 11 in several ways, the only concern being to provide a structurally sound framework to enable the individual to vigorously brush and stimulate his teeth and gums in order to promote dental hygiene. In the preferred embodiment, as shown in FIG. 1, the neck portion 26 on head 17 is fixedly cemented into position in throat portion 27 of the handle. This method of attachment requires that the handle and head both be disposed of and discarded when the dentifrice material in cavity 13 is exhausted. A first possible alternate embodiment, which would achieve a similar result, would be to form the handle and head as one integral unit thereby maximizing structural stability and eliminating those manufacturing steps required to separately form and join the handle and head pieces. The dentrifice material could then be injected through the holes or apertures 23 through 25 in the brushing surface of the head.

A second possible alternate embodiment, as shown in FIG. 2, is to tap and thread the throat and neck portions 27 and 26, respectively, or to provide a tongue and groove or other similar arrangement such that head 17 can be removed from handle 11 when the dentifrice material in cavity 13 is exhausted. Head 17 could then be retained and attached to other filled replacement handles thereby saving on material costs and allowing head 17 to be used on several handle portions until the brushing surface becomes so worn that it too must be discarded.

Although the various dimensions and material composition of the handle and head portions may vary greatly according to availability and the specific objectives and desires of the individual manufacturer, it is necessary that such dimensions and composition are chosen such that the thin-walled portion 15 in the handle can be readily compressed by normal manual exertion of a sufficient amount to collapse offset cavity 13. In this manner, mere compression of the thin-walled portion is all that is required in order to force dentifrice material into the inner cavity 18 in the head and out through the outlet openings 23 through 25 in the brushing surface 22. In this same regard, the specific dimensions and location of offset cavity 13 and the material composition of handle 11 must also be such that thick-walled portion 16 is generally rigid and not compressible. It then provides a sturdy frame which allows the individual to vigorously brush and stimulate his teeth and gums in order to promote dental hygiene.

In the preferred embodiment, handle 11 is molded as one integral piece of a thermoplastic material with the thickness of thin-walled portion 15 being such that it may be readily compressed by manual exertion to collapse offset cavity 13 and force dentifrice material through head 17. The added thickness of portion 16 then provides the generally rigid and noncompressible structure which significantly aids in the brushing operation.

This thermoplastic material of the preferred embodiment can be any commercially available thermoplastic material exhibiting a high degree, or exaggerated property, of resiliency. In this context, "resiliency" is meant to indicate a material that is elastic in the sense that it can withstand a shock or distortion without rupturing or experiencing any permanent structural deformation. In a metallurgical sense, all materials exhibit some elastic properties and may be stressed within a specific elastic range or limit before they plastically, or permanently, deform. However, the preferred embodiment contemplates a thermoplastic material exhibiting a high degree of elasticity or resiliency, substantially greater than normally experienced, such that the resilient thin-walled portion 15 can be resiliently compressed within its elastic limit a sufficient amount to collapse offset cavity 13.

Figure 3:
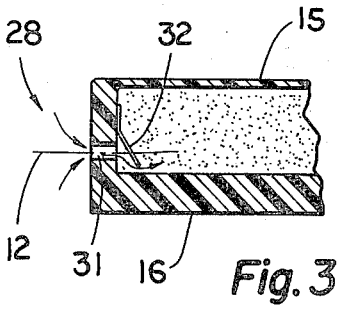
FIG. 3 is an enlarged sectional view of the air intake arrangement in the handle of the preferred embodiment of the present invention.

Some form of air intake device or means is then located in the handle at a point distal from throat portion 27. An example of such a device 28, used in the handle 11 in the preferred embodiment, is shown in FIG. 3 and includes an aperture or hole 31 connecting the outside atmosphere with the offset cavity 13 and an inner flange or flap 32 which is hingedly attached to the wall defining cavity 13 directly above aperture 31. Flap 32 is sufficiently large to completely block, or close, the inside opening of aperture 31 as to prevent dentifrice material from leaking or draining out the aperture during normal storage or use. When the resilient thin-walled portion 15 is compressed as shown by dotted line 34 in FIG. 1, flap 32 is forced against the aperture thereby tightly sealing the offset cavity and allowing dentifrice material to be forced into head 17. When the pressure is released, however, the resilient and elastic quality of the handle material will tend to return the thin-walled portion to its original configuration. Such motion would normally be opposed by the fact that the offset cavity now contains less dentifrice material and a partial vacuum would therefore be created if portion 15 is allowed to assume its original shape. Air intake device 28 eliminates the opposition, however, by allowing outside air to flow into the area of reduced pressure in cavity 13 created by the returning of portion 15.

Such an arrangement therefore permits the thin-walled portion 15 of handle 11 to retain its original configuration between uses of toothbrush 10. In addition, the air in cavity 13 provides extra pressure when the thin-walled portion 15 is compressed during subsequent uses thereby helping to force the remaining dentifrice material out of cavity 13 and on to the brushing surface 22.

Referring now again to FIGS. 1 and 2, the portion of inner cavity 18 in the neck portion 26 of head 17 is in the form of a venturi tube configuration, including a reduced diameter portion 33 which experiences an increased material velocity and corresponding decreased internal pressure according to well-accepted physical principles. Although not required to practice the present invention, this venturi configuration aids in "shooting," or propelling, the dentifrice material into the main body of cavity 18 and on to the brushing surface.

As also shown in FIGS. 1 and 2, the three outlet openings 23 through 25 decrease in relative size and inner diameter as they approach handle 11. Specifically, opening 23 is smaller than opening 24 which is in turn smaller than opening 25. The reason for such difference relates to the relative ease and rate with which the dentrifice material may flow through variously sized openings. By making opening 23 the smallest, only a small amount of the dentifrice material flows through the opening to the brushing surface. Instead, the major flow of material passes by opening 23 with a significant portion flowing through the next opening 24. However, by making opening 24 relatively smaller than the total flow of material, a substantial amount of the material passes opening 24 and exits through the most distal and largest opening 25. In this manner, it is assured that dentifrice material will flow out each opening when the thin-walled portion 15 of handle 11 is compressed a sufficient amount to at least partially collapse the filled offset cavity 13. The number and individual size of the respective openings may, of course, vary greatly according to the dimensions of the specific head and the objectives and desires of the individual maufacturer. However, the relative size of each opening should remain as above explained.

Figure 4:
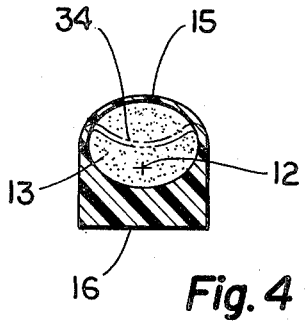
FIG. 4 is a cross-sectional view of the handle in FIG. 1 taken along line 4—4.
Figure 5:
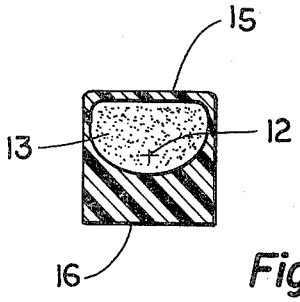
FIG. 5 is a cross-sectional view of an alternate embodiment for the handle in the disposable toothbrush combination in FIG. 1.

FIG. 4 depicts a cross-sectional view of handle 11 of the preferred embodiment taken along line 4—4 in FIG. 1, the dotted line 34 indicating thin-walled portion 15 in a partially compressed position. The exact configuration of the handle 11 and offset cavity 13 can, of course, vary greatly. In this regard, FIG. 5 depicts only one possible alternate configuration for the handle and offset cavity of the present invention, many others clearly being workable and within both the contemplation and scope of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A disposable toothbrush dentifrice combination comprising:

(a) an elongated handle having a central axis and an elongated cavity offset from the central axis therein, the offset cavity containing an amount of dentifrice material and defining a thin-walled portion and a thick-walled portion in said handle, said thick-walled portion located closer to said axis than said thin-walled portion;

(b) a head having an inner elongated cavity through which said axis extends and a plurality of bristles defining a brushing surface thereon, said head further including a plurality of outlet openings in the brushing surface connected to the inner cavity therein;

(c) means for attaching said head to said handle and for connecting the inner cavity in said head with the offset cavity in said handle; and wherein:

(d) said thin-walled portion in said handle is movable toward said thick-walled portion along the entire length of said handle to force the dentifrice material into the cavity in said head and out through the outlet openings in the brushing surface, the thick-walled portion in said handle being generally rigid and not compressible;

(e) the inner cavity in said head includes a constricted passage with opposite flared ends through which said axis extends and wherein said dentifrice material flows through said constricted passage at a higher velocity and a lower pressure than at either of said flared ends when said thin-walled portion is moved toward said thick-walled portion, one of said opposite flared ends opens directly into said offset cavity;

said handle is one integral piece of a resilient thermoplastic material, said means for compressing and for forcing comprising means for compressing the resilient thin-walled portion in said handle within its elastic limit a sufficient amount to collapse the offset cavity in said handle, and said handle includes air intake means for allowing air to flow into the offset cavity in said handle after the thin-walled portion thereof has been compressed;

said air intake means includes an aperture through which said axis extends with said aperture in said handle opening into the offset cavity therein; and an inner flap hingedly attached inside the cavity and positioned to cover the inner opening of said aperture, said hinged flap being responsive to close said aperture when the resilient thin-walled portion in said handle is compressed, said hinged flap being responsive to open said aperture and allow air to enter the offset cavity after the compressing and while the resilient thin-walled portion returns to its original configuration;

the outlet openings in the brushing surface on said head vary in size, the outlet openings nearer said handle being increasingly smaller than the openings more distant therefrom.

2. The combination of claim 1 wherein said handle and said head each have threaded ends in meshing engagement allowing the head to be removed from the handle for refilling of dentifrice material.

3. A disposable toothbrush dentifrice combination comprising:

(a) an elongated handle having a central axis and an elongated cavity offset from the central axis therein, the offset cavity containing an amount of dentifrice material and defining a thin-walled portion and a thick-walled portion in said handle, said thick-walled portion located closer to said axis than said thin-walled portion;

(b) a head having an inner elongated cavity through which said axis extends and a plurality of bristles defining a brushing surface thereon, said head further including a plurality of outlet openings in the brushing surface connected to the inner cavity therein;

(c) means for attaching said head to said handle and for connecting the inner cavity in said head with the offset cavity in said handle; and wherein:

(d) said thin-walled portion in said handle is movable toward said thick-walled portion along the entire length of said handle to force the dentifrice material into the cavity in said head and out through the outlet openings in the brushing surface, the thick-walled portion in said handle being generally rigid and not compressible;

(e) the inner cavity in said head includes a constricted passage with opposite flared ends through which said axis extends and wherein said dentifrice material flows through said constricted passage at a higher velocity and a lower pressure than at either of said flared ends when said thin-walled portion is moved toward said thick-walled portion, one of said opposite flared ends opens directly into said offset cavity, said constricted passage formed by a uniformly smooth convex wall surrounding said constricted passage;

said handle includes air intake means for allowing air to flow into said offset cavity, said air intake means includes an aperture through which said axis extends with said aperture in said handle opening into the offset cavity therein, and an inner flap hingedly attached inside the cavity and positioned to cover the inner opening of said aperture, said hinged flap being responsive to close said aperture when the resilient thin-walled portion in said handle is compressed, said hinged flap being responsive to open said aperture and allow air to enter the offset cavity after the compressing and while the resilient thin-walled portion returns to its original configuration;

the outlet openings in the brushing surface on said head vary in size, the outlet openings nearer said handle being increasingly smaller than the openings more distant therefrom.

* * * * *